US006714626B1

(12) United States Patent
Subraya et al.

(10) Patent No.: US 6,714,626 B1
(45) Date of Patent: Mar. 30, 2004

(54) JET COOLED X-RAY TUBE WINDOW

(75) Inventors: Madhusudhana T. Subraya, New Berlin, WI (US); Carey S. Rogers, Waukesha, WI (US); Michael J. Price, Big Bend, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 10/065,392

(22) Filed: Oct. 11, 2002

(51) Int. Cl.[7] ..... H01J 35/16
(52) U.S. Cl. ..... 378/141; 378/199; 378/119
(58) Field of Search ..... 378/141, 142, 378/203, 119, 121, 123, 127, 128, 130, 140, 199, 200, 202

(56) References Cited

U.S. PATENT DOCUMENTS 6,215,852 B1 * 4/2001 Rogers et al. ..... 378/142
6,263,046 B1 * 7/2001 Rogers ..... 378/141
6,301,332 B1 10/2001 Rogers et al.
6,438,208 B1 8/2002 Koller

* cited by examiner

*Primary Examiner*—David V. Bruce
*Assistant Examiner*—Hoon Song
(74) *Attorney, Agent, or Firm*—Pete Vogel

(57) ABSTRACT

An x-ray tube window cooling assembly (11) for an x-ray tube (18) is provided. The cooling assembly (11) includes an electron collector body (110) coupled to an x-ray tube window (104) and having a first coolant circuit (112). The coolant circuit (112) includes a coolant inlet (114) and a coolant outlet (122). The coolant outlet (122) directs coolant at an x-ray tube window surface (152) to impinge upon and cool the x-ray tube window (104). The coolant is reflected off the reflection surface (146) as to impinge upon and cool the x-ray tube window (104). A method of operating the x-ray tube (18) is also provided.

20 Claims, 4 Drawing Sheets

JET COOLED X-RAY TUBE WINDOW

CROSS REFERENCE TO RELATED APPLICATIONS

The present invention is related to U.S. Pat. No. 6,215,852 B1 entitled "Thermal Energy Storage and Transfer Assembly", which is incorporated by reference herein.

BACKGROUND OF INVENTION

The present invention relates generally to thermal energy management systems within electron beam generating devices, and more particularly, to an assembly for cooling an x-ray tube window.

There is a continuous effort to increase x-ray imaging system scanning capabilities. This is especially true in computed tomography (CT) imaging systems. Customers desire the ability to perform longer scans at high power levels. The increase in scan time at high power levels allows physicians to gather CT images and constructions in a matter of seconds rather than several minutes as with previous CT imaging systems. Although the increase in imaging speed provides improved imaging capability, it causes new constraints and requirements for the functionality of the CT imaging systems.

CT imaging systems include a gantry that rotates at various speeds in order to create a 360° image. The gantry contains a x-ray tube, which composes a large portion of the rotating gantry mass. The CT tube generates x-rays across a vacuum gap between a cathode and an anode. In order to generate the x-rays, a large voltage potential is created across the vacuum gap allowing electrons to be emitted, in the form of an electron beam, from the cathode to a target within the anode. In releasing of the electrons, a filament contained within the cathode is heated to incandescence by passing an electric current therein. The electrons are accelerated by the high voltage potential and impinge on the target, whereby they are abruptly slowed down to emit x-rays. The high voltage potential produces a large amount of heat within the x-ray tube, especially within the anode.

Typically, a small portion of energy within the electron beam is converted into x-rays; the remaining electron beam energy is converted into thermal energy within the anode. The thermal energy is radiated to other components within a vacuum vessel of the x-ray tube, and is removed from the vacuum vessel via a cooling fluid circulating over an exterior surface of the vacuum vessel. Additionally, electrons within the electron beam are back scattered from the anode and impinge on other components within the vacuum vessel, causing additional heating of the x-ray tube. As a result, the x-ray tube components are subject to high thermal stresses decreasing component life and reliability of the x-ray tube.

The vacuum vessel is typically enclosed in a casing filled with circulating, cooling fluid, such as dielectric oil. The casing supports and protects the x-ray tube and provides for attachment to a computed tomography (CT) system gantry or other structure. Also, the casing is lined with lead to provide stray radiation shielding. The cooling fluid often performs two duties: cooling the vacuum vessel, and providing high voltage insulation between the anode and cathode connections in the bi-polar configuration. High temperatures at an interface between the vacuum vessel and a transmissive window in the casing cause the cooling fluid to boil, which may degrade the performance of the cooling fluid. Bubbles may form within the fluid and cause high voltage arcing across the fluid, thus degrading the insulating ability of the fluid. Further, the bubbles may lead to image artifacts, resulting in low quality images.

Prior art cooling methods have primarily relied on quickly dissipating thermal energy by using a circulating, coolant fluid within structures contained in the vacuum vessel. The coolant fluid is often a special fluid for use within the vacuum vessel, as opposed to the cooling fluid that circulates about the external surface of the vacuum vessel. Other methods have been proposed to electromagnetically deflect backs-scattered electrons so that they do not impinge on the x-ray window. These approaches, however, do not provide for significant levels of energy storage and dissipation. Due to inherent poor efficiency of x-ray production and desire for increased x-ray flux, heat load is increased that must be dissipated. As power of x-ray tubes continues to increase, heat transfer rate to the coolant can exceed heat flux absorbing capabilities of the coolant.

A thermal energy storage device or electron collector, coupled to an x-ray window, has been used to collect back scattered electrons between the cathode and the anode. In using this device the collector and window need to be properly cooled to prevent high temperature and thermal stresses, which can damage the window and joints between the window and collector. High temperature on the window and collector can induce boiling of coolant. Bubbles from boiling coolant obscure the window and thereby compromise image quality. Further boiling of the coolant results in chemical breakdown of the coolant and sludge formation on the window, which also results, in poor image quality.

A heat exchange chamber has been coupled to the electron collector, including a cooling channel, which allows coolant to flow in the channel across each of four walls of the electron collector. Although, the heat exchange chamber aids in cooling the electron collector, it is difficult to effectively manufacture due to its complexity and large number of seams, which each need to be properly sealed. Also, the heat exchange chamber is minimally effective in cooling of and preventing deposits from forming on the x-ray tube window. For further description of the electron collector or of the heat exchange chamber see U.S. Pat. No. 6,215,852 B1.

It Would therefore be desirable to provide an apparatus and method of cooling an x-ray tube window, thus an x-ray tube, that allows for increased scanning speed and power, is relatively easy to manufacture, and minimizes blurring and artifacts in a reconstructed image.

SUMMARY OF INVENTION

The present invention provides an assembly for cooling an x-ray tube window. An x-ray tube window cooling assembly for an x-ray tube is provided. The cooling assembly includes an electron collector body coupled to an x-ray tube window and having a first coolant circuit. The coolant circuit includes a coolant inlet and a coolant outlet. The coolant outlet directs coolant at an x-ray tube window surface to impinge upon and cool the x-ray tube window. The coolant is reflected off the reflection surface as to impinge upon and cool the x-ray tube window. A method of operating the x-ray tube is also provided.

The present invention has several advantages over existing x-ray tube cooling systems. One of several advantages of the present invention is that it provides an apparatus for directing coolant at an x-ray tube window. By directing coolant at the x-ray tube window the window is efficiently cooled, deposit formation on the window is minimized, and deposits are washed away as soon as they are formed, thus minimizing blurring and artifacts in a reconstructed image.

Another advantage of the present invention is that it provides a cooling mechanism or fin pocket, which effectively removes thermal energy from the coolant. The fin pocket is located on a coolant side of the electron collector body, providing relative ease in manufacturing of the present invention.

Furthermore, the present invention provides additional x-ray tube window cooling via an auxiliary cooling circuit, further allowing for Increased scanning speed and operating power, while being able to effectively cool the x-ray tube window.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

While the present invention is described with respect to an assembly for cooling an x-ray tube window within a computed tomography (CT) Imaging system, the following apparatus and method is capable of being adapted for various purposes and is not limited to the following applications: MRI systems, CT systems, radiotherapy systems, flouroscopy systems, X-ray imaging systems, ultrasound systems, vascular imaging systems, nuclear imaging systems, magnetic resonance spectroscopy systems, and other applications known in the art.

In the following description, various operating parameters and components are described for one constructed embodiment. These specific parameters and components are included as examples and are not meant to be limiting.

Also, in the following description the term "impinge" refers to an object colliding directly with another object. For example, as known in the art, an electron beam impinges upon a target of an anode within an x-ray tube. The electron beam is directed at the target and electrons within the beam collide with the target. Similarly, a coolant may be directed at a surface as to collide with the surface. The coolant in being directed at a surface and may be reflected from another surface. The term "impinge" does not refer to an object simply coming into contact with another object, such as coolant flowing over a surface of an object.

Figure 1:
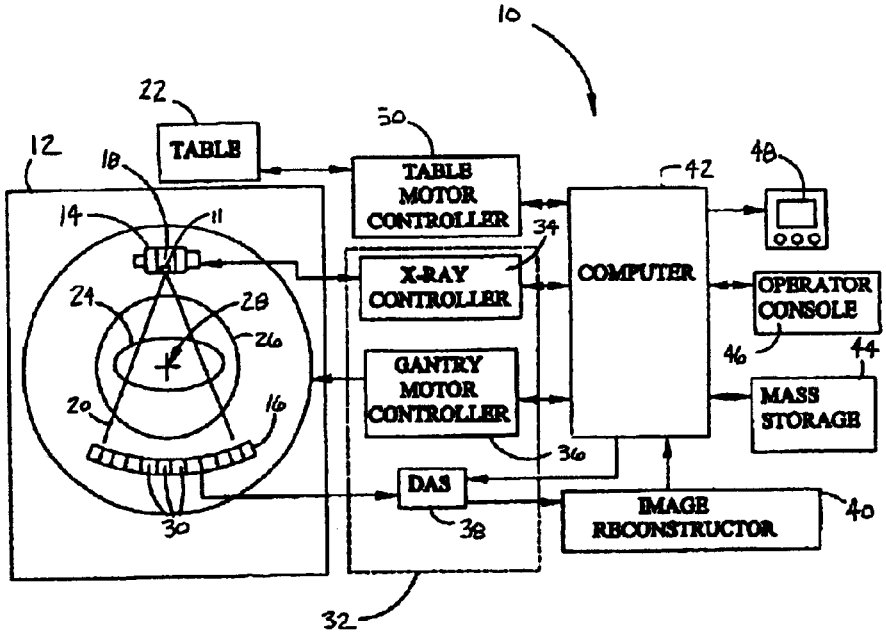
FIG. 1 is a schematic block diagrammatic view of a multi-slice CT imaging system utilizing an x-ray tube window cooling assembly in accordance with an embodiment of the present invention.

Referring now to FIG. 1, a schematic block diagrammatic view of a multi-slice CT imaging system 10 utilizing an x-ray tube window cooling assembly 11 in accordance with an embodiment of the present invention is shown. The imaging system 10 includes a gantry 12 that has an x-ray tube assembly 14 and a detector array 116. The x-ray tube assembly 14 has an x-ray generating device or x-ray tube 18. The tube 18 projects a beam of x-rays 20 towards the detector array 16. The tube 18 and the detector array 16 rotate about an operably translatable table 22. The table 22 is translated along a z-axis between the assembly 14 and the detector array 16 to perform a helical scan. The beam 20 after passing through a medical patient 24, within a patient bore 26, is detected at the detector array 16 to generate projection data that is used to create a CT image.

The tube 18 and the detector array 16 rotate about a center axis 28. The beam 20 is received by multiple detector elements 30. Each detector element 30 generates an electrical signal corresponding to intensity of an impinging x-ray beam. As the beam 20 passes through the patient 24 the beam 20 is attenuated. Rotation of gantry 12 and the operation of tube 18 are governed by a control mechanism 32. Control mechanism 32 includes an x-ray controller 34 that provides power and timing signals to the tube 18 and a gantry motor controller 36 that controls the rotational speed and position of gantry 12. A data acquisition system (DAS) 38 samples analog data from the detector elements 30 and converts the analog data to digital signals for subsequent processing. An image reconstructor 40 receives sampled and digitized x-ray data from the DAS 38 and performs high-speed image reconstruction. A main controller or computer 42 stores the CT image in a mass storage device 44.

The computer 42 also receives commands and scanning parameters from an operator via an operator console 46. A display 48 allows the operator to observe the reconstructed image and other data from the computer 42. The operator supplied commands and parameters are used by the computer 42 in operation of the DAS 38, the x-ray controller 34, and the gantry motor controller 36. In addition, the computer 42 operates a table motor controller 50, which translates the table 22 to position patient 24 in gantry 12.

The x-ray controller 34, the gantry motor controller 36, the image reconstructor 40, the computer 42, and the table motor controller 50 are preferably microprocessor-based such as a computer having a central processing unit, memory (RAM and/or ROM), and associated input and output buses. The x-ray controller 34, the gantry motor controller 36, the Image reconstructor 40, the computer 42, and the table motor controller 50 may be a portion of a central control unit or may each be standalone components as shown.

Figure 2:
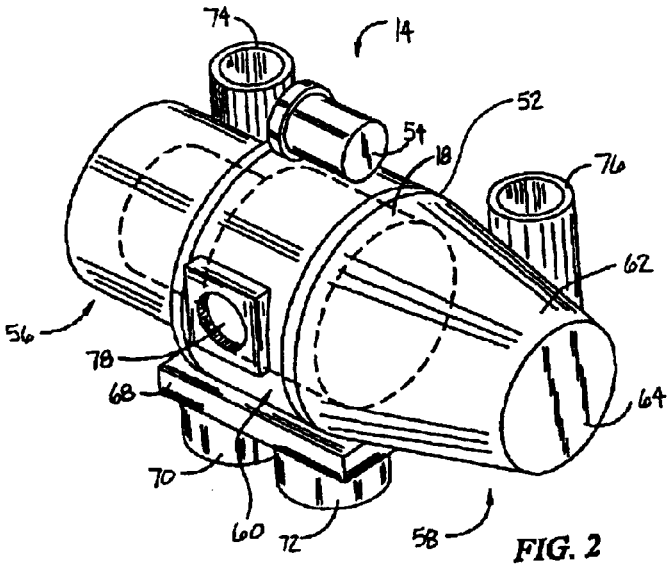
FIG. 2 is a perspective view of a x-ray tube assembly incorporating the x-ray tube window cooling assembly in accordance with an embodiment of the present invention.

Referring not to FIG. 2, a perspective view of the x-ray tube assembly 14 incorporating the cooling assembly 11 in accordance with an embodiment of the present invention is shown. The tube assembly 14 includes a housing unit 52 having a coolant pump 54, an anode end 56, a cathode end 58, and a center section 60 positioned between the anode end 56 and cathode end 58, which contains the x-ray tube 18. The x-ray tube 18 is enclosed in a fluid chamber 62 within lead-lined casing 64. The chamber 62 is typically filled with fluid, such as dielectric oil, but other fluids including water or air may be utilized. The fluid circulates through housing 52 to cool the x-ray tube 18 and may insulate casing 64 from high electrical charges within the x-ray tube 18. A radiator 68 for cooling fluid 66 is positioned to one side of the center section 60 and may have fans 70 and 72 operatively connected to the radiator 68 for providing cooling air flow over the radiator 68. Pump 54 is provided to circulate fluid 66 through housing 52, through radiator 68, and through the cooling assembly 11. Electrical connections in communication with the x-ray tube 18 are provided through an anode receptacle 74 and a cathode receptacle 76. A casing window 78 is provided for x-ray emission from the casing 64.

Figure 3:
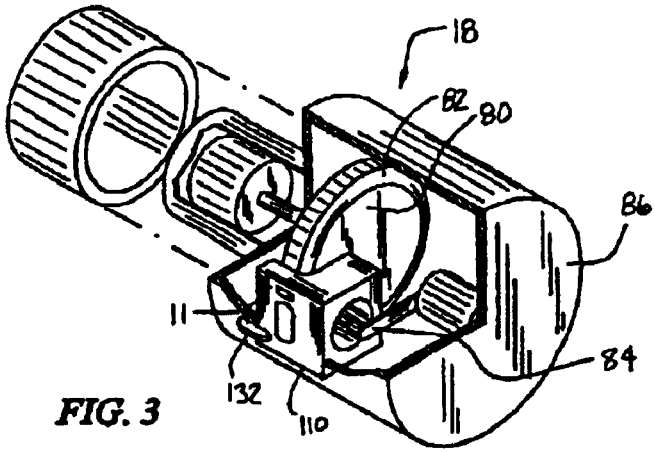
FIG. 3 is a sectional perspective view of an x-ray tube incorporating the x-ray tube window cooling assembly in accordance with an embodiment of the present invention.
Figure 4:
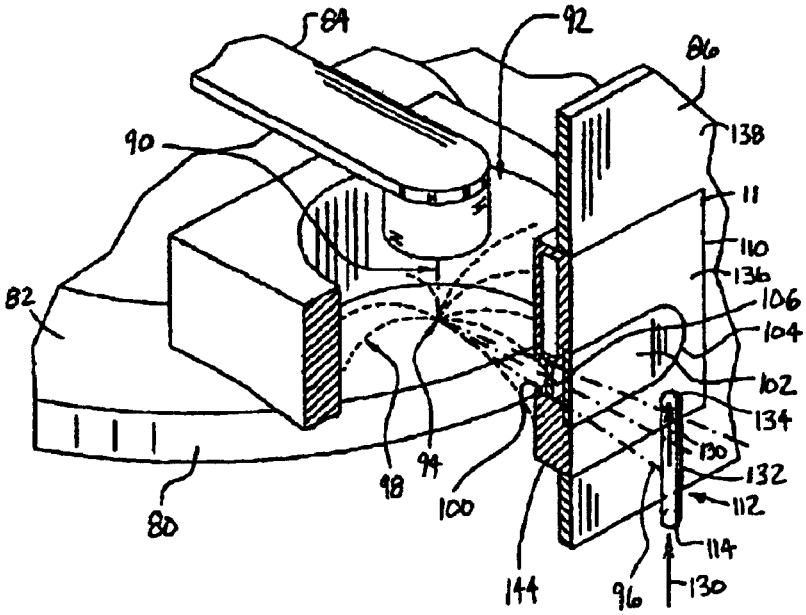
FIG. 4 is a close-up sectional perspective view of the x-ray tube incorporating the x-ray tube window cooling assembly in accordance with an embodiment of the present invention.

Referring now to FIGS. 3 and 4, sectional perspective views of the x-ray tube 18 incorporating the cooling assembly 11 in accordance with an embodiment of the present invention is shown. The x-ray tube 18 includes a rotating anode 80, having a target 82, and a cathode assembly 84 disposed in a vacuum within vessel 86. The cooling assembly 11is interposed between the anode 80 and the cathode 84.

In operation, an electron beam 90 is directed through central cavity 92 and accelerated toward the anode 80. The electron beam 90 impinges upon a focal spot 94 on the target 82 and produces high frequency electromagnetic waves or x-rays 96 and residual energy. The residual energy is absorbed by components within the x-ray tube 18. X-rays 96 are directed through the vacuum toward an aperture 100 in cooling assembly 11. Aperture 100 collimates x-rays 96, thereby reducing radiation dosage received by patient 24.

The residual energy includes radiant thermal energy from anode 80 and kinetic energy of back scattered electrons 98 that deflect off the anode 80. The kinetic energy is converted into thermal energy upon impact with components in the vessel 86. A portion of the kinetic energy is absorbed by the cooling assembly 11 and transferred to coolant circulating therein.

Disposed within aperture 100 is x-ray tube window 102, formed of a material that efficiently allows passage of x-rays 96. Window 102 is hermetically sealed to cooling assembly 11 at joint 104, such as by vacuum brazing or welding. Seal 104 serves to maintain the vacuum within vessel 86. Also, filter 106 is disposed between anode 80 and window 102, mounted within aperture 100. Similar to window 102, filter 106 allows the passage of diagnostic x-rays 96. Thus, x-ray tube 18 generates residual energy and x-rays 96 that are directed out of the x-ray tube 18 through filter 106 and window 102.

Figure 5:
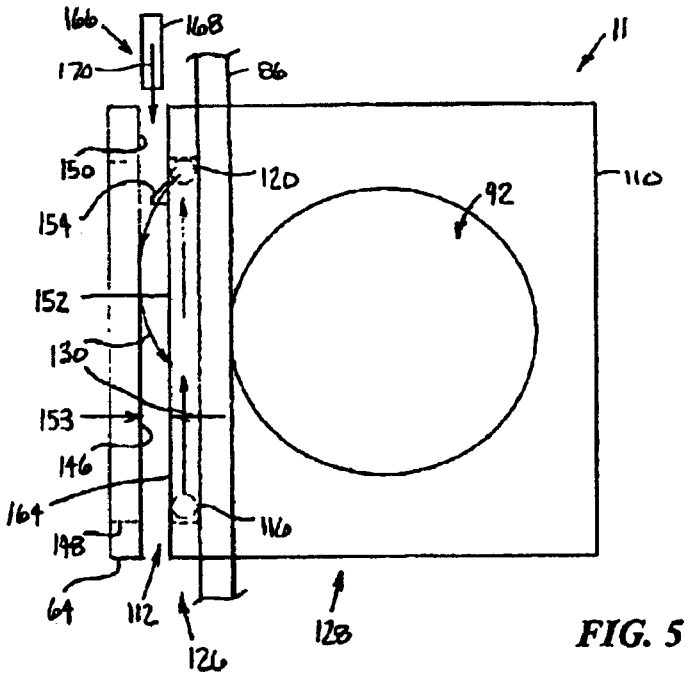
FIG. 5 is a top view of the x-ray tube window cooling assembly in accordance with an embodiment of the present invention.
Figure 6:
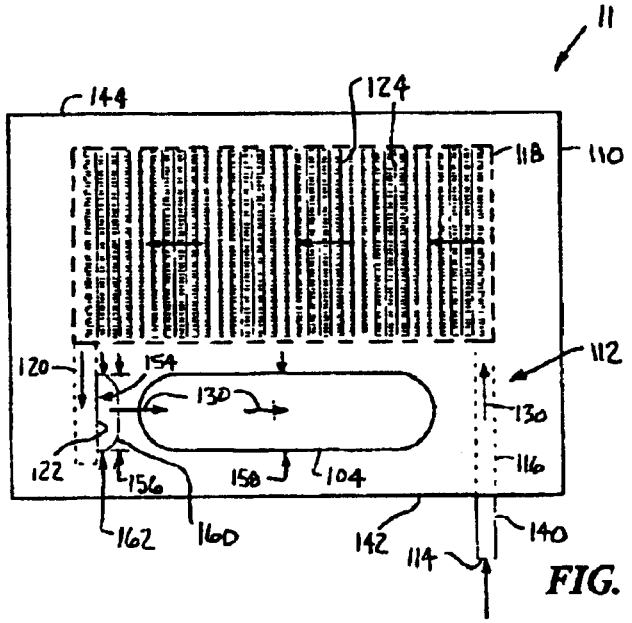
FIG. 6 is a front view of the x-ray tube window cooling assembly in accordance with an embodiment of the present invention.

Referring now to FIG. 4 and to FIGS. 5 and 6, where a front view and a side view of the cooling assembly 11 in accordance with an embodiment of the present invention are shown. The cooling assembly 11 includes an electron collector body 110 with a first coolant circuit 112. The first coolant circuit 112 includes a coolant inlet 114, a first channel 116 a fin pocket 118, a second channel 120, and a coolant outlet 122. Coolant is received through the inlet 114, through the first channel 116, is cooled by multiple cooling fins 124 within the fin pocket 118, through the second channel 120, and is then directed at the window 104 by the outlet 122.

The collector 110 has a coolant side 126 and a vacuum side 128. The coolant side 126 includes the inlet 114 and the outlet 122. In one embodiment of the present invention, as illustrated by FIGS. 3 and 4, coolant, represented by arrows 130, enters the first channel 116 via a first external tube 132 coupled over an opening 134 in a collector exterior surface 136 of the collector 110. In the embodiment of FIGS. 3 and 4, the vessel exterior surface 138 is flush with the collector surface 136. In another embodiment of the present invention, as illustrated by FIGS. 4 and 5, when the collector 110 protrudes from the vessel 86, a second external tube 140 may be attached on a lower side 142 of the collector 110.

The fin pocket 118 is located within a single wall 144 of the collector 110 above the window 104. By having the fin pocket 118 only on the coolant side 126, risk of vacuum leak is minimized since the fins 124 are not brazed to a side of the collector that is on the vacuum side 128, as there are in prior art thermal energy storage devices. When fins are brazed into a side of a collector, seams are created, which can develop leaks over time. The present invention by incorporating the fins in a single wall 144 of the collector 110, eliminates the seams within the collector 110, on the vacuum side 128, resulting in less potential for vacuum leaks. Although, the fin pocket 118 may be on multiple sides of the collector 110 and may be in multiple locations, by having the fin pocket located as stated the present invention provides simplicity in manufacturing while maintaining efficient thermal transfer. Although, multiple cooling fins 124 are shown as lanced offset cooling fins, other style cooling fins, or high efficiency extended cooling surfaces known in the art may be used.

The outlet 122 directs coolant at a reflection surface 146 on the x-ray tube 118. The reflection surface 146 may be a portion of a transmissive device 148 of the casing 64, as shown, may be an internal casing wall surface 150, or other deflecting surface known in the art. The reflection surface 146 is located opposite that of an x-ray tube window surface 152, with a gap 153 therebetween. Coolant 130 passing through the fin pocket 118 is directed from the outlet 122 to reflect off the reflection surface 146 as to impinge upon and cool the window 104. The gap 153 may be of various width and may be adjusted such that the coolant 130 impinges appropriately on the window 104.

The outlet 122 has an opening 154 with a cross-sectional area that is smaller relative to cross-sectional area of said fin pocket 118, perpendicular to direction of coolant flow, such that as coolant 130 is passed from the fin pocket 118 through the outlet 122, velocity of the coolant 130 increases. By increasing coolant velocity, the outlet 122 in conjunction with the fin pocket 118 performs as a coolant jet, which further aids in cooling the window 104. Also, opening width 156 of the outlet 122 is approximately equal to window width 158 of the window 104, such that coolant 130 impinges across width of and provides uniform cooling of the window 104.

A guide 160 may be incorporated to aid in direction of the coolant 130. The guide 160 also has similar width 162 to that of the opening width 156 and width 158. The guide 160 may be in various form, size, and style. The guide 160 may protrude from the collector 110, as shown, or may be incorporated within the collector 110 as to be more flush with the collector exterior surface 164.

The transmissive device 148 is in the form of a transmissive window allowing the x-rays 96 to pass through the casing 64. The transmissive device 148 may be formed of aluminum or other material known in the art.

A second coolant circuit 166 may be incorporated within the cooling assembly 11 including an auxiliary coolant jet 168 directing additional coolant 170 to flow across the window surface 152, as best seen in FIG. 5. The auxiliary jet 168 is preferably directing coolant 170 in the same direction as flow of current 130 from the outlet 122 to increase current flow, rather than restrict current flow, and thus, increasing cooling of the window 104. The auxiliary jet 168 may be in various locations and have various orientations.

The cooling circuits 112 and 166 may receive coolant 130 from the pump 54, via a separate pump, or some other coolant source as known in the art.

Figure 7:
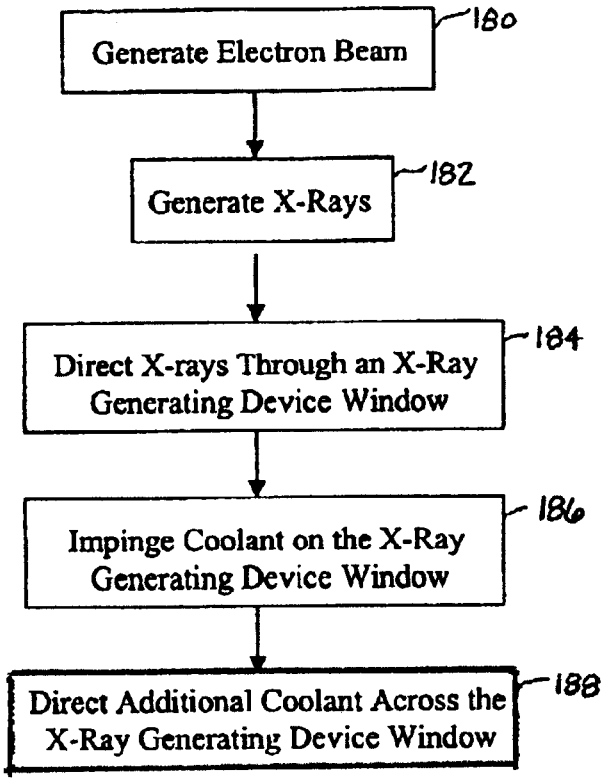
FIG. 7 is a logic flow diagram illustrating a method of operating an x-ray generating device in accordance with an embodiment of the present invention.

Referring now to FIG. 7, a logic flow diagram illustrating a method of operating the x-ray tube 18 in accordance with an embodiment of the present invention is shown.

In step 180, the electron beam 90 is generated as stated above.

In step 182, the electron beam 90 is directed to impinge upon the target 82 as to generate the x-rays 96.

In step 184, the x-rays 96 are directed through the window 104, which increases temperature of the window 104. Back-scattered electrons 98, from the electron beam 90, are also impinging upon the window 104 further increasing temperature of the window 104.

In step 186, coolant 130 is passed through the fin pocket 118 and is directed at the reflection surface 146, as to impinge on and cool the window 104.

In step 188, additional coolant 170 may be directed across the window 104, via the second cooling circuit 166.

The above-described steps are meant to be an illustrative example, the steps may be performed synchronously or in a different order depending upon the application.

The present invention provides an x-ray generating device window cooling system that provides improved cooling and is relatively simple to manufacture. Coolant is directed at and across an x-ray tube window preventing generation of deposits and decreasing dwell time of oil on the window, thus preventing oil sludge build-up. The window is efficiently cooled and deposits that exist are separated from the window and washed away, thus minimizing blurring and artifacts in a reconstructed image. Elimination of cooling pockets on the vacuum side of a thermal energy storage device reduces opportunity for leaks and particle contamination.

The above-described apparatus and method, to one skilled in the art, is capable of being adapted for various applications and systems known in the art. The above-described invention can also be varied without deviating from the true scope of the invention.

What is claimed is:

1. An x-ray tube window cooling assembly for an x-ray tube comprising:

an electron collector body coupled to an x-ray tube window and having a first coolant circuit comprising;

a coolant inlet and a coolant outlet, said coolant outlet directing coolant at an x-ray tube window surface to impinge upon and cool the x-ray tube window.

2. An assembly as in claim 1 wherein said coolant outlet in directing coolant at said x-ray tube window directs said coolant at and reflects said coolant off of a reflection surface on the x-ray tube, opposite that of said x-ray tube window surface and impinges said coolant upon said x-ray tube window surface.

3. An assembly as in claim 2 wherein said reflection surface is an inner side of an x-ray tube casing.

4. An assembly as in claim 3 wherein said inner side is a portion of an x-ray transmissive device.

5. An assembly as in claim 1 wherein said electron collector body further comprises a fin pocket.

6. An assembly as in claim 5 wherein said fin pocket comprises a plurality of lanced offset cooling fins or extended cooling surfaces.

7. An assembly as in claim 5 wherein said fin pocket is coupled to a single wall of said electron collector body.

8. An assembly as in claim 1 wherein cross-sectional area of an opening of said coolant outlet is smaller relative to cross-sectional area of said fin pocket, perpendicular to direction of coolant flow.

9. An assembly as in claim 1 wherein opening width of said coolant outlet is approximately equal to width of the x-ray tube window.

10. An assembly as in claim 1 further comprising a second coolant circuit comprising an auxiliary coolant jet directing coolant flow across said x-ray tube window surface.

11. An assembly as in claim 1 wherein said electron collector body comprises an oil side and a vacuum side, said oil side comprising said coolant inlet and said coolant outlet.

12. An assembly as in claim 1 further comprising a guide coupled to said electron collector body and directing coolant at said reflection surface as to impinge upon and cool the x-ray tube window.

13. An x-ray tube comprising:

a housing unit;

a cathode coupled within said housing unit and generating an electron beam;

an anode coupled within said housing unit and receiving said electron beam and generating x-rays that are directed through an x-ray tube window; and an x-ray tube window cooling assembly comprising;

an electron collector body coupled to said x-ray tube window and having a first coolant circuit comprising;

a coolant inlet and a coolant outlet, said coolant outlet directing coolant at a reflection surface on the x-ray tube, opposite that of an x-ray tube window surface, to reflect said coolant off said reflection surface as to impinge upon and cool said x-ray tube window.

14. An x-ray tube as in claim 13 wherein said x-ray tube window cooling assembly is interposed between said cathode and said anode.

15. An x-ray tube as in claim 13 wherein said electron collector body further comprises a fin pocket coupled to a single side of said electron collector body.

16. An x-ray tube as in claim 13 wherein cross-sectional area of an opening of said coolant outlet is smaller relative to cross-sectional area of said fin pocket, perpendicular to direction of coolant flow.

17. An x-ray tube as in claim 13 wherein opening width of said coolant outlet is approximately equal to width of the x-ray tube window.

18. An x-ray tube as in claim 13 further comprising a second coolant circuit comprising an auxiliary coolant jet directing coolant flow across said x-ray tube window surface.

19. A method of operating an x-ray generating device comprising:

generating an electron beam;

directing said electron beam at impinge upon an anode target to generate x-rays;

directing said x-rays through an x-ray tube window increasing temperature of the x-ray tube window; and directing coolant at a reflection surface on the x-ray tube, opposite that of an x-ray tube window surface, to reflect said coolant off said reflection surface as to impinge upon and cool the x-ray tube window, via a first cooling circuit.

20. A method as in claim 19 further comprising directing additional coolant across said x-ray tube window surface via a second cooling circuit.

* * * * *